United States Patent [19]

Chang

[11] Patent Number: 4,726,581

[45] Date of Patent: Feb. 23, 1988

[54] EXERCISE STAIR DEVICE

[76] Inventor: Shao-Ying Chang, 764, Chung Shan South Rd., Tung Liu Precinct, Yang Mei Town, Tao Yuan Hsien, Taiwan

[21] Appl. No.: 881,655

[22] Filed: Jul. 3, 1986

[51] Int. Cl.[4] ..... A63B 23/06

[52] U.S. Cl. ..... 272/70; 272/69; 272/130

[58] Field of Search ..... 272/69, 70, 70.2, 130; 182/37, 42, 43

[56] References Cited

U.S. PATENT DOCUMENTS

| | | | |
|---|---|---|---|
| 481,565 | 8/1892 | Hunt | 182/43 |
| 2,042,764 | 6/1936 | Birch | 272/69 |
| 3,497,215 | 2/1970 | Harrison et al. | 272/69 |
| 3,592,466 | 7/1971 | Parsons | 272/69 |
| 4,555,108 | 11/1985 | Montetro | 272/69 |

*Primary Examiner*—V. Millin
*Assistant Examiner*—John Welsh
*Attorney, Agent, or Firm*—Burns, Doane, Swecker & Mathis

[57] ABSTRACT

A novel exerciser which simulates the exercise obtained while climbing stairs includes a frame body, a fixed step, a handle member and a pair of shaft supporting stands. A chain sprocket assembly has parallel upper and lower drive shafts rotatably supported on the supporting stands, two pairs of sprockets mounted on the drive shafts, a pair of chains wound around the two pairs of chain wheels, and a plurality of equi-spaced movable steps connected to the chains. A speed reduction brake system makes use of the hydraulic resistance to apply a resistance force to reduce the speed of the chains. A control device regulates the resistance force being applied.

2 Claims, 4 Drawing Figures

EXERCISE STAIR DEVICE

BACKGROUND AND OBJECTS OF INVENTION

The present invention relates to an exercise stair devices, and more particularly to room exercise stair devices designed to exercise, strengthen and tone various muscles of the legs.

At present, there are many kinds of room exercise devices available on the market and the most frequently seen apparatus designed to exercise the legs and the general capability and stamina of the body include room exercise cycles and joggers. Though the exercise cycles are suitable for normal healthy persons to take daily exercises, these devices are nevertheless inappropriate for performing gentle rehabilitation of the leg muscles by physically handicapped or wounded persons. The joggers, on the other hand, are designed generally for people to practice slow or fast running exercises in a room and may be employed as a temporary means which simulates the exercise obtained while walking for rehabilitation of the legs. However, because of the absence in the device of a simple and appropriate control means for speed and application of force in harmony with the varied physiological and body endurance conditions in the individual user to a make appropriate adjustment, these joggers have not been very effective. Furthermore, while an exercise cycle can perform generally the cycling exercises only like pedalling on a bicycle, the joggers, on the other hand, perform plain running and walking exercises only. However, a stair climbing type apparatus having the capacity for simulating the exercise obtained while climbing stairs and in conforming to body weight, and the ability to be adjusted in conformance to the physiological and body endurance conditions of the individual user is still wanting.

It is the purpose of this invention to provide a novel room exercise stair apparatus which is capable of adjustment in a most appropriate way in conformity with the physiological and body endurance conditions and body weight of individual users and achieving the best effect of exercise rehabilitation or leg rehabilitation.

Accordingly, it is an object of this invention to provide a room exerciser designed to exercise the body endurance or rehabilitate the legs by a user with both hands grasping the handle thereof and the two legs climbing on one step after the other at the same place in simulating the exercise obtained while climbing stairs.

It is a further object of this invention to provide a room exerciser including a chain sprocket device for the user to pedal thereon at the same place, a hydraulic braking system regulating the resistance force and motion speed thereof in an appropriate way in harmony with the physiological and body endurance conditions of the user.

A still further object of the present invention is to provide a room exerciser which is simple in construction, effective in use and low in manufacturing cost, and occupying little space in the room.

BRIEF DESCRIPTION OF THE DRAWINGS

Other objects and features of this invention will be apparent from the following detailed description of embodiment accompanied by drawing, in which.

DETAILED DESCRIPTION OF A PREFERRED EMBODIMENT

Figure 1:
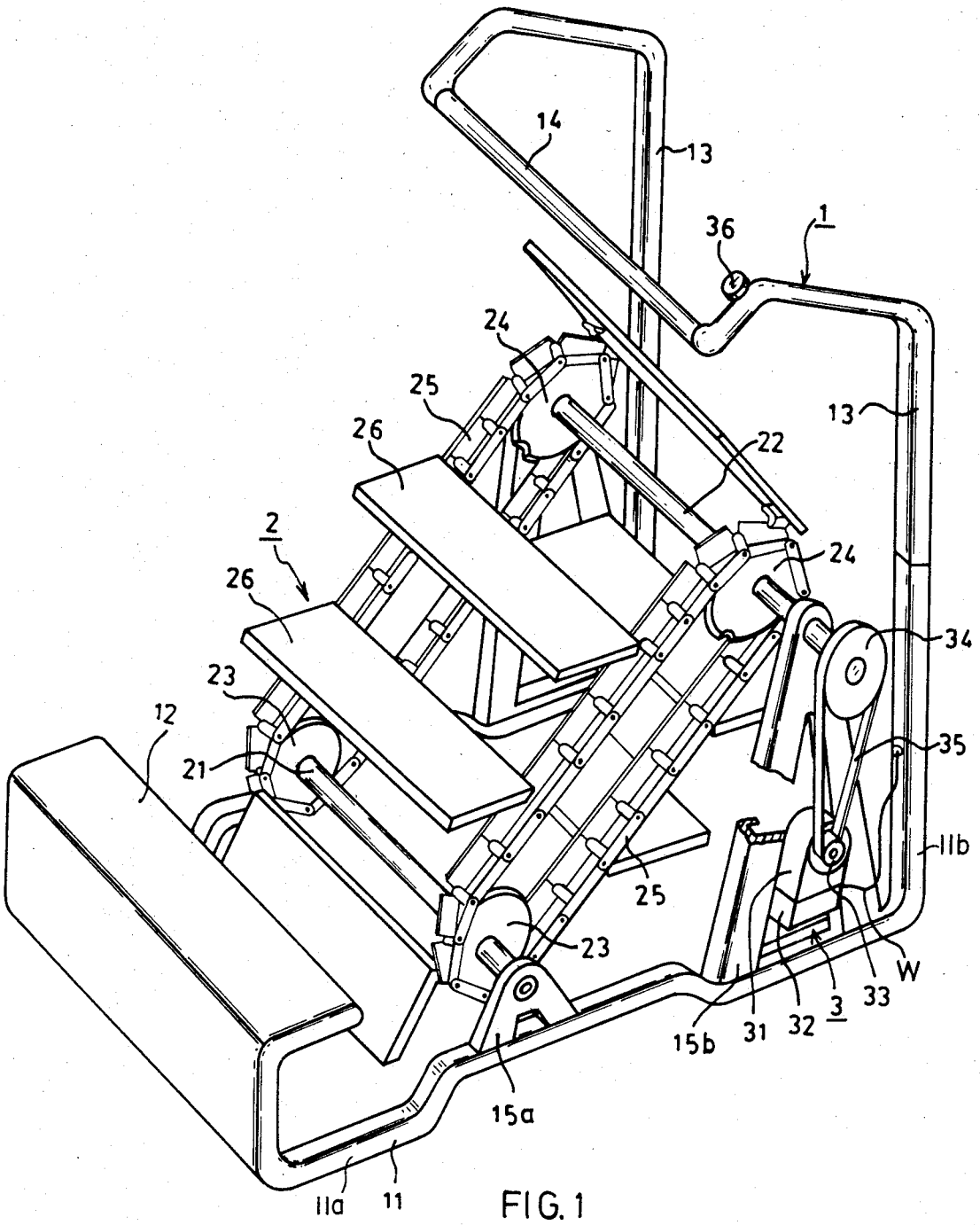
FIG. 1 is a perspective view of a room exercise stair device in accordance with the invention.

Referring now to the drawing and in particular to FIG. 1, there is shown a room exercise stair device of the present invention, which comprises a frame body 1, a chain sprocket assembly 2 movably obliquely mounted on the frame body 1 and a hydraulic brake unit 3 for controlling the chain sprocket assembly 2.

The frame body 1 is a rectangular frame with an L-shaped lateral side, principally formed by being molded from circular or square-shaped metal pipe. The frame body includes a pair of base members 11 running parallel with each other, each comprising a horizontal ground support bar 11*a* and an upright bar 11*b* disposed at a rear end of the horizontal bar. An upwardly extending and then rearwardly bent fixed step 12 transversely interconnects the front ends of the two base frame members 11. A pair of upwardly extended and then inwardly bent support tubular members 13 connected to the upright bars of the base members 11. A handle member 14 is transversely disposed at the upper ends of the two support tubular members 13. A pair of shaft supporting stands 15*a* and 15*b* is fixed to the two base frame members 11 for supporting the chain sprocket assembly 2. The fixed step 12 comprises a bent plate having an upright portion and a horizontal portion.

Figure 4:
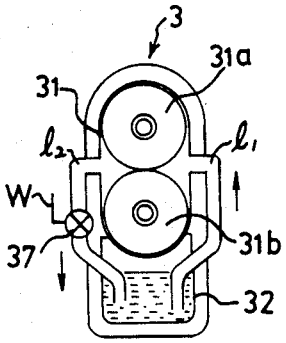
FIG. 4 is a schematic view of a gear pump of the room exercise stair device, showing the internal construction of the pump.

The chain sprocket assembly 2 is disposed slantingly on the frame body 1 between the fixed step 12 and the support tubular members 13 and includes a lower drive shaft 21 having both ends thereof rotatably supported on the shaft supporting stands 15*a* by means of shaft bearings. An upper drive shaft 22 has both ends thereof rotatably supported on the shaft supporting stands 15*b* by means of shaft bearings and extends parallel to the lower drive shaft 21. A pair of lower sprocket 23 are mounted on the opposite ends of the lower drive shaft 21, and a pair of upper sprocket 24 are mounted on opposite ends of the upper drive shaft 22. Endless chains 25 extend around the upper and lower sprockets 23 and 24 and a plurality of equispaced movable steps 26 are disposed between and connected to the two chains 25. Each step comprises a planar plate having an inner edge mounted to the chains and an outer free edge, i.e., the plate is mounted in cantilever fashion. As shown in FIGS. 1 and 4, the hydraulic brake unit 3 is located at one side of the shaft supporting stands 15*b* and comprises a rear pump 31, a tank 32 to provide the brake fluid to the gear pump 31, a tank 32 to provide the brake fluid to the gear pump 31, a driven pulley 33 coupled to the main drive shaft of this gear pump 31, a drive pulley 34 mounted on one end of the upper drive shaft 22, a drive belt 35 suspendedly located between the two pulleys 33 and 34, and a control knob 36 mounted to the upper end of one of the support tubular members 13 at a location close to the handle member 14. By means of a steel wire w the knob 36 is attached to a flow control valve 37 of the gear pump 31 at the side of a discharge pipe.

The brake fluid tank 32 communicates with the gear pump 31 respectively by means of a suction pipe 1, and a discharge pipe $1_2$, which two pipes $1_1$, $1_2$ have the same diameter. The flow control valve 37 is mounted on the discharge pipe $1_2$ such that by varying the opening of the flow control valve 37 it is possible to produce in the fluid inside the gear pump 31 a resistance force which will in turn exert a corresponding braking force to two gears 31*a*, 31*b* of the gear. pump 31. When this braking force is transmitted to the pulley 34 by way of the pulley 33 and drive belt 35, the speed in the chains 25 will thereby slope down.

In use of the exercise stair device of the present invention as constructed above, the user must first place his feed on the fixed step 12 and grasp the handle member 14 with both hands. In this position, the user can then proceed like climbing stairs with one foot stepping on the one movable step 26 of lower position in the chain 25 and next he steps his other foot on the movable step 26 of higher position. Now, owing to the whole body weight falling on the chain 25, the chain 25 will move downwardly thereby causing the sprockets 23 and 24 to rotate. Since the upper sprockets 24 are subject to the braking effect of a hydraulic resistance force formed as a result of the amount of outflow fluid being lesser than that of inflow fluid from the hydraulic brake unit 3, the steps 26 will be moved slowly downwardly. Furthermore, as the body weight, the physiological and body endurance conditions are not the same in different individuals, the user may, according to the conditions in each person and the progress in rehabilitation exercises, regulate the opening of the flow regulating valve in the gear pump by way of the steel wire by rotation of the control knob 36 to obtain appropriate exercise resistance and to further receive the most effective result.

Figure 2:
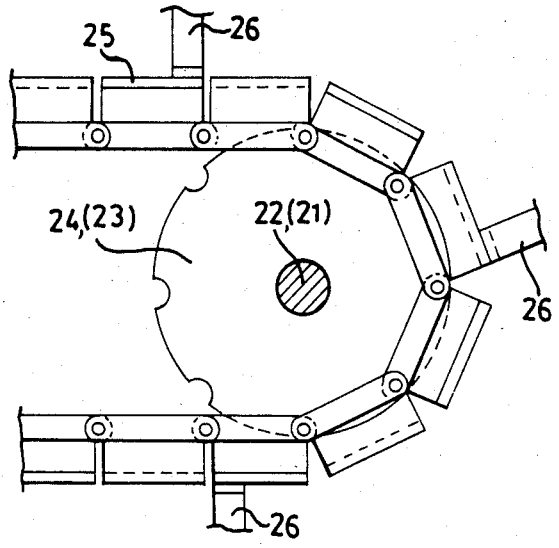
FIG. 2 is a partial, enlarged view of the main portion of a chain sprocket assembly in one embodiment of the room exercise stair device.

In the embodiment alluded to hereinbefore, the chains 25 and sprockets 23 and 24 adopt a structure as illustrated in FIG. 2. However in the actual practice, it is not to be limited in the sprockets and chains of such kind of structure. Depending on the opposite practicing conditions, it is possible to employ many currently appropriate chain sprocket assembly units. Even a conveying belt in which there is stretched between the two chains an endless rubber belt or mesh belt to which there are pivotally connected equispaced movable steps 26 can be employed.

It should be appreciated that in addition to the above described hydraulic brake unit the friction type brake means having brake with shoes and lining or of other kind currently in use may also be employed as a speed reduction or brake means to provide exercise resistance in accordance with the body weight and conditions. This means is preferably mounted on the upper drive shaft, or on the lower drive shaft depending upon whether there is sufficient space for fitting thereof.

Figure 3:
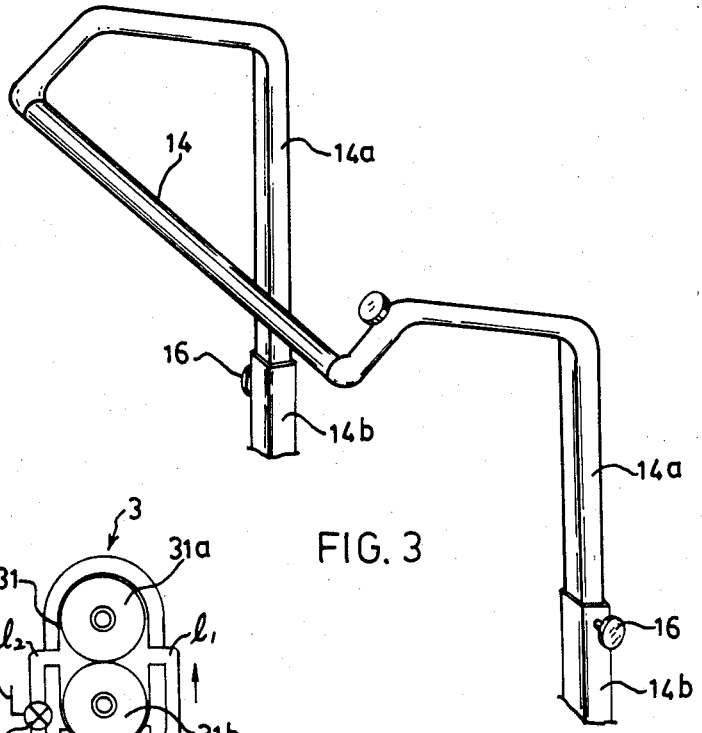
FIG. 3 is a schematic view of handle adjusting means in one embodiment of the room exercise stair device of the invention.

Further to the above it should be appreciated that in order to regulate the height of the handle 14 freely so as to match with the body height of the user, the support tubular member 13 may be constructed as upper and lower sections 14*a* and 14*b* connected by a telescoping joint as shown in FIG. 3, and the upper section 14*a* can be retractable in relation to the lower section 14*b* and made stationary by a fixing nut 16.

I claim:

1. An exercise stair device comprising:

an integral one-piece frame body comprising a pair of horizontally extending, mutually horizontally spaced ground support bars disposed parallel to each other, a pair of upright, parallel bars extending upwardly from rear ends of respective ground support bars, and a fixed step member comprising a bent plate interconnecting front ends of said ground support bars, said plate including an upright portion and a horizontal portion extending from an upper end of said upright portion, a horizontal handle member connected directly to upper end of said upright bars, front and rear pairs of upright shaft support stands extending upwardly from said ground support bars intermediate said front and rear ends thereof, said rear stands spaced rearwardly of said front stands and extending higher than said front stands, a lower horizontal shaft connected between upper ends of said front stands for rotation about a lower horizontal axis, a pair of lower chain sprocket wheels attached to opposite ends of said lower shaft, an upper horizontal shaft connected between upper ends of said rear stands for rotation about an upper horizontal axis, a pair of upper chain sprocket wheels attached to opposite ends of said upper shaft, a pair of chains, each chain extending around one of said lower sprocket wheels and one of said upper sprocket wheels, a plurality of movable cantilever-mounted steps each comprising a planar plate having an inner edge connected to respective ones of said chains, and an outer free edge situated opposite said inner edge, such that a user climbing said movable steps causes said upper and lower sprocket wheels to rotate, and braking means operably connected to one of said shafts to brake the rotation of said chains, said braking means comprising:

a gear pump including a housing and a pair of meshing rotary gears therein, a fluid reservoir, a suction conduit interconnecting said reservoir with an intake side of said pump, a discharge conduit interconnecting said reservoir with a discharge side of side pump, means connecting one of said gears with said one shaft to transmit rotation from said one shaft to said one gear, an adjustable valve in one of said conduits for restricting the flow of fluid therethrough, and a manual control member mounted on said handle for operation by a user, said control member operably connected to said valve for adjusting the rate of fluid flow through said valve and accordingly vary the speed of said movable steps.

2. An exercise stair device according to claim 1, wherein said handle is vertically adjustable relative to said frame body.

* * * * *